US008585481B2

(12) United States Patent
Owen et al.

(10) Patent No.: US 8,585,481 B2
(45) Date of Patent: Nov. 19, 2013

(54) WAGERING GAME METHOD, GAMING MACHINE, GAMING SYSTEM, AND PROGRAM PRODUCT FACILITATING TOURNAMENT PLAY

(75) Inventors: Clint Owen, Austin, TX (US); Bradley Johnson, Austin, TX (US); Juan Salazar, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 123 days.

(21) Appl. No.: 13/243,854

(22) Filed: Sep. 23, 2011

(65) Prior Publication Data

US 2013/0079107 A1 Mar. 28, 2013

(51) Int. Cl.
*G07F 17/32* (2006.01)

(52) U.S. Cl.
USPC ..... 463/16; 463/20; 463/25; 463/29

(58) Field of Classification Search
USPC ..... 463/16, 20, 25, 29
See application file for complete search history.

(56) References Cited

U.S. PATENT DOCUMENTS

| | | | | |
|---|---|---|---|---|
| 5,544,892 | A | 8/1996 | Breeding | |
| 5,779,549 | A | 7/1998 | Walker et al. | |
| 6,019,374 | A | 2/2000 | Breeding | |
| 6,224,486 | B1 | 5/2001 | Walker et al. | |
| 6,287,202 | B1 | 9/2001 | Pascal et al. | |
| 6,354,592 | B1 | 3/2002 | Virzi | |
| 6,425,828 | B2 | 7/2002 | Walker et al. | |
| 6,817,948 | B2 | 11/2004 | Pascal et al. | |
| 7,390,255 | B2 | 6/2008 | Walker et al. | |
| 7,824,253 | B2 | 11/2010 | Thompson et al. | |
| 7,854,653 | B2 | 12/2010 | Kane | |
| 2002/0039923 | A1 * | 4/2002 | Cannon et al. | 463/42 |

* cited by examiner

*Primary Examiner* — Omkar Deodhar
(74) *Attorney, Agent, or Firm* — Russell D. Culbertson, Esq.; JP Cody, Esq.

(57) ABSTRACT

A method includes receiving one or more primary game inputs at a gaming machine, each primary game input defining a wager for a respective play of a primary game presented through the gaming machine and also initiating the respective play of the primary game. Each qualifying wager in the primary game offered through the gaming machine is applied in a predefined fashion toward to an entry fee in one or more gaming machine tournaments. Ultimately, the value of the tournament entry fee account may reach a first level which is predefined as a level required for participation in a tournament. Once this level has been reached, the method includes enabling the affected player to participate in the tournament. Thus the player need not stop play of the wagering game to pay any entry fee which may be required for participation in a tournament game.

18 Claims, 7 Drawing Sheets

WAGERING GAME METHOD, GAMING MACHINE, GAMING SYSTEM, AND PROGRAM PRODUCT FACILITATING TOURNAMENT PLAY

COPYRIGHT NOTICE

A portion of the disclosure of this patent document contains material which is subject to copyright protection. The copyright owner has no objection to the facsimile reproduction of the patent document or the patent disclosure, as it appears in the Patent and Trademark Office patent files or records, but otherwise reserves all rights.

BACKGROUND OF THE INVENTION

1. Field of the Invention

This invention relates to wagering games, gaming machines, gaming systems, and associated methods and program products. More particularly, the invention relates to a wagering game in which facilitates a player's entry into one or more tournaments so that the player may participate in various types of gaming tournaments.

2. Description of the Related Art

Numerous types of wagering games have been developed in an attempt to provide players with new and varied gaming experiences. In addition to providing primary games, a gaming machine may offer one or more bonus or feature games. These bonus or feature games may be offered in an effort to vary the play at the gaming machine, and to offer enhanced prizes which help hold the player's interest. Gaming machines which offer wagering games may also provide tournament play in which players compete against each other in the play of a primary or other game offered through the gaming machine. Various prizes may be offered for the tournament winner and high ranking players (such as the second and third place players for the tournament).

Gaming machine tournaments may require that each participating gaming machine be removed from regular gaming machine play. In these "out-of-revenue" tournaments, the operating casino is compensated by charging tournament entry fees and is not necessarily compensated by a share of the wagers placed in the tournament games. Other types of gaming machine tournaments continue to require a wager for each play in the tournament. In these "in-revenue" tournaments, the operating casino continues to receive a share of wagers placed at the gaming machines in the course of the tournament in addition to any entry fee charged for participation in the tournament.

There remains a need in the field of wagering games for tournament gaming systems which facilitate easy enrollment for players wishing to participate in tournament games, and which minimize the impact on regular "in-revenue" play at the gaming machines.

SUMMARY OF THE INVENTION

A method according to an exemplary form of the invention includes receiving one or more primary game inputs at a gaming machine. Each of these primary game inputs (which may themselves include one or more player inputs) define a wager for a respective play of a primary game presented through the gaming machine, and also initiate the respective play of the primary game. At least one of the primary game inputs defines a qualifying wager for a respective play of the primary game. Each qualifying wager in the primary game offered through the gaming machine is applied toward an entry fee in one or more gaming machine tournaments. Thus the player need not stop play of the wagering game to pay any entry fee which may be required for participation in a tournament game.

According to this example method, an outcome for each play of the primary game is generated and a graphical representation of the respective outcome is displayed at a display device associated with the gaming machine. A payout for each respective winning outcome is also awarded to the wagering player according to a paytable for the primary game. Each qualifying wager placed for a respective play of the primary game is applied toward a tournament entry fee in this particular embodiment by incrementing a value of a tournament entry fee account associated with that respective play of the primary game. Ultimately, the value of the tournament entry fee account may reach a first level which is predefined as a level required for participation in a first tournament. In response to the value of the tournament entry fee account reaching this first level, the example method includes enabling participation in the first tournament. Participation may be through the same gaming machine through which the player played the primary game or through another gaming machine.

A gaming system according to one or more embodiments of the present invention includes at least one display device, a player input system, at least one processor, and at least one memory device storing instructions executable by the processor(s). The instructions may be executable in these embodiments to receive the primary game inputs entered through the player input system to initiate respective plays of the primary game. The instructions may also be executable to generate an outcome for each play of the primary game, cause the display device or devices to display the graphical representation of the respective outcome, and award a payout for each respective winning outcome according to the paytable for the primary game. For each qualifying wager placed for a respective play of the primary game, the instructions are executable by the processor(s) to increment the value of the associated tournament entry fee account, and to enable participation in the first tournament in response to the value of the tournament entry fee account reaching the first predefined level representing an entry level for that tournament.

The instructions executed by the various processing devices which may be included in a gaming system implementing embodiments of the present invention may be embodied in suitable computer program code. Thus the invention encompasses program products executable to provide various functions and operations to implement embodiments of the invention. Such program products may be stored in any suitable computer-readable device, including any suitable non-transitory medium, and may include player input program code, primary game program code, tournament entry program code, and tournament game program code. The player input program code is executable to receive the primary game inputs and to receive tournament game inputs entered through the player input system once tournament game play is enabled at the gaming machine. The primary game program code is executable to generate outcomes for the primary game, control the gaming machine display devices to display graphical representations of the outcomes, and to award the payouts for the primary game. The tournament entry program code is executable to increment a value of a tournament entry fee account for qualifying primary game wagers, and to enable participation in given tournament in response to the value of the tournament entry fee account reaching the predefined level for that tournament. The tournament game program code is executable to generate outcomes for the tournament game play and control the display of the graphical representations for those outcomes. The tournament game program code is also executable to award tournament points for each respective winning outcome for the tournament game according to a paytable for the tournament game.

These and other advantages and features of the invention will be apparent from the following description of illustrative embodiments, considered along with the accompanying drawings.

DESCRIPTION OF ILLUSTRATIVE EMBODIMENTS

In the following disclosure, FIG. 1 will be used to describe an example of a wagering game tournament process according the present invention. FIGS. 2-7 will then be used to describe various components of a gaming system which may be used to implement embodiments of the present invention. Finally, an example gaming tournament organizing process will be described in connection with FIG. 8.

Figure 1:
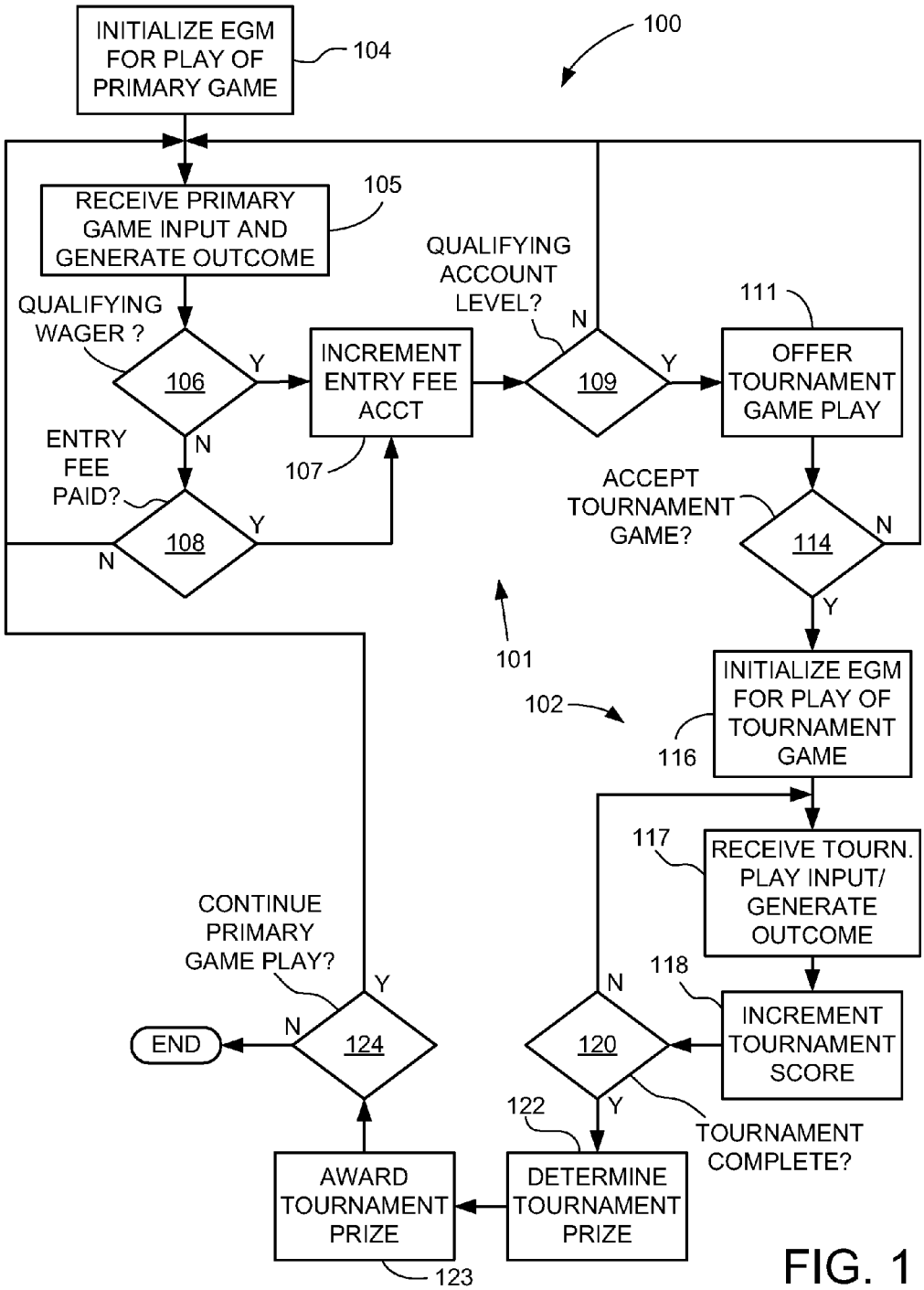
FIG. 1 is a flow chart showing an example tournament gaming process according to one or more embodiments of the present invention.

Referring to FIG. 1, a process 100 for facilitating gaming machine tournament play may include two different constituent processes shown generally at reference numerals 101 and 102. A tournament qualifying portion 101 of the overall process 100 allows the play of a primary wagering game to essentially pay down the entry fee associated with one or more tournament games which may be offered in a wagering game system such as that described below in connection with FIG. 7. A tournament play portion 102 of the overall process 100 allows a player to play a tournament game for which an entry fee has been paid according to the tournament qualifying portion 101 of overall process 100.

Tournament qualifying process 101 includes initializing a gaming machine (EGM) foreplay of a primary game as shown at process block 104. This initializing step may include receiving a number of player inputs at a given gaming machine (such as gaming machine 400 described below in connection with FIGS. 4-6) to place the gaming machine in a condition in which the player may participate in the primary wagering game (which may be referred to simply as the "primary game") offered through the gaming machine. For example, a player may be required to insert cash or a credit voucher into a suitable device included at the gaming machine to place wagering credits on the gaming machine. The player may also be required go through a login process at a gaming machine using a player card or some other player identifier. The present invention encompasses any arrangement of inputs which may be required for initializing a gaming machine for play of the primary game.

With the given machine initialized for play of the primary game, the illustrated example process 100 includes receiving a primary game input as shown at process block 105. This primary game input defines a wager for the primary game and initiates a respective play of the primary game through the gaming machine. It will be appreciated that a given primary game input to initiate a play of a primary game may encompass several separate inputs. For example, receiving a primary game input may include receiving a wager input, a denomination input, a line activation input (for reel-type games) and perhaps other inputs in addition to a "play" input which all together constitute a primary game input to initiate play in the primary game. The present invention is not limited by any manner in which a primary game play input may be received in a given gaming system.

According to the illustrated example process 100, there are two different process routes by which a player may qualify for the play of a tournament game. The first route involves a process of employing qualifying wagers in the play of the primary game to pay down an entry fee for the play of a tournament. This route is shown in FIG. 1 from decision block 106, through process block 107, decision block 109, process block 111 and decision block 114. The second route is through decision block 106 and decision block 108 shown in FIG. 1. Through this route, the player may simply pay all or a remaining part of a tournament entry fee to qualify for the play of the desired tournament game.

According to the first route to qualify for participation in a tournament game, if the primary game input received at process block 105 defines a qualifying wager as indicated by a positive outcome at decision block 106, the process branches to process block 107 for incrementing an entry fee account. A qualifying wager may be any level or type of wager defined in the given gaming system as being sufficient to warrant incrementing the entry fee account at process block 107. For example, a qualifying wager for a given implementation may be defined as a wager over certain number of credits or perhaps a maximum wager possible through the gaming machine for a given play of the primary game. Other implementations may define every wager as a qualifying wager and the level of the wager may simply determine the amount of the increment performed at process block 107. Regardless of how a qualifying wager is defined and the amount by which the entry fee account is incremented at process block 107, the step of incrementing an entry fee account based on wagers placed in the primary wagering game allows a player to buy in to a tournament without having to make any separate entry to pay a tournament entry fee which may be required for the tournament. Without any separate entry to pay a tournament entry fee, once the entry fee account reaches some predefined level as indicated by a positive outcome at decision block 109, the player in this example process is presented with an offer to play one or more tournaments associated with an entry fee which is covered by the value of the entry fee account. This offer is shown at process block 111. If the player accepts the offer to enter a tournament as indicated by a positive outcome a decision block 114, the process continues to the tournament play portion 102 of the overall process 100 as described further below.

An example may be helpful in illuminating a process of playing the primary game to qualify for participation in a tournament game according to implementations of the invention. Assume the gaming system through which process 100 is implemented offers a single tournament having an entry fee of $50. Assume also that each qualifying wager placed at a gaming machine in the gaming system increments the entry fee account for a given player or gaming session by one-half dollar. In this example, 100 qualifying wagers entered through the gaming machine would add sufficient value to the entry fee account to cover the $50 entry fee for participation in the tournament.

The gaming process shown in FIG. 1 may employ any of a number of arrangements by which the entry fee account referenced at process block 107 may be maintained and incremented. In anonymous gaming systems, an entry fee account may be established at the start of each anonymous gaming session. For example, the creation of an entry fee account may be created in a system implementing the process as part of the initialization of a gaming machine at process block 104 for an anonymous gaming session. Alternatively, where players are tracked through a player identifier or player account identifier, entry fee accounts may be created separately from the gaming machine initialization process, for example, during a player identifier or player account identifier setup process. Associating the entry fee account incremented as at process block 107 in FIG. 1 with a player identifier or player account identifier has the advantage that the entry fee account may be maintained even when the player moves from one gaming machine to another in the gaming system. Even in anonymous gaming systems, it is possible to create an account for a player for the sole purpose of enabling the entry fee account to be accessed from any suitable gaming machine in a gaming system. Various apparatus and systems for maintaining entry fee accounts according to the tournament qualifying process 101 shown in FIG. 1 will be described in connection with FIGS. 4-6 below.

Regardless of how the entry fee account is created and maintained, it should be appreciated that such an account is not limited to any particular types of units. For example, the account may be maintained in terms of dollars. Alternatively, the entry fee account referenced in FIG. 1 may be maintained in terms of credits.

The processes indicated at process block 111 and decision block 114 may require interaction with the player at the gaming machine through which the primary game is played. A suitable display device included at the gaming machine may be used to display the offer indicated at process block 111. This display may or may not be accompanied by an audio announcement or some other audio output. A suitable player input device may be included at the gaming machine to allow the player to make an input accepting the tournament game or declining the offered tournament game. As will be discussed below in connection with FIGS. 4-6, the display device for displaying the offer at process block 111 and the user input device through which the tournament game may be accepted or declined, may be part of the regular display system and user interface included at a gaming machine, or may be part of a separate tournament interface system included at the gaming machine.

It should be appreciated that the process shown in FIG. 1 accommodates more than one tournament which may be offered to a player. For example, a tournament gaming system may offer three different tournaments, each associated with a different entry fee and a different potential prize for participation in the tournament. In the case where multiple tournaments are available, the player may have the option of using the value in their entry fee account for any one of the tournaments. For example, a tournament gaming system may offer a basic level tournament associated with an entry fee of $10, and a top prize of $500, and may offer a higher level tournament associated with an entry fee of $50 and a top prize of $10,000. In this case, the player may wish to forego the basic level tournament and use the value collected in their entry fee account only for the higher level tournament. Continuing with this example, as the player continues to play the primary game they will inevitably first reach the qualifying account level for the basic level tournament, that is, the $10 entry fee. Thus when the player in this example is offered participation in the basic level tournament at process block 111, the player would decline that offer through the suitable interface and thus the process would return from the negative outcome at decision box 114 to continue play of the primary game. It is also possible within the scope of the present invention for the player (or play at a given gaming machine) may be associated with multiple entry fee accounts which may each be associated with a respective tournament. In this multiple account case, the player may use a suitable interface to define how the total entry fee account incrementing credit for a given qualifying wager is apportioned among the various entry fee accounts.

Thus far the discussion of the tournament qualifying portion 101 of overall process 100 has focused on tournament qualification through play of the primary game at the gaming machine. However, the second route for tournament qualification shown in FIG. 1 does not rely entirely on pay entry fee options. In particular, the player at the gaming machine offering the primary game may use a suitable interface arrangement at the gaming machine to simply pay the entry fee for a given tournament using currency or credits entered into the gaming machine for the play of the primary game or entered into a separate tournament game interface at the gaming machine. The player may pay the entry fee for a given tournament prior to any play of the primary game at the gaming machine or after one or more plays in the primary game have been initiated. Also, a player having some credit accumulated in a entry fee account through play of the primary game, and not wishing to wait to collect the full amount necessary to participate in a tournament, may simply pay the remaining portion of a required entry fee as indicated by a positive outcome at decision box 108. In either case, the payment may be used to increment the appropriate entry fee account as indicated at process block 107. Once it is determined that the entry fee account covers the tournament entry fee by the comparison to required entry fee levels indicated at decision box 109, the process may proceed to offer the tournament to the player as indicated at process block 111, and the player would then accept the tournament and begin tournament play.

In the tournament play portion 102 of overall process 100, the gaming machine (EGM) is initialized for play of the tournament game which the player has accepted as indicated by the positive outcome at decision box 114. This initialization step shown at process block 116 may include changing the graphics provided by one or more display devices at the gaming machine to modify the game offered through the gaming machine. Once the gaming machine is initialized for play of the tournament, the example process shown in FIG. 1 includes receiving a tournament play input as shown at process block 117, and generating an outcome for that play of the tournament game in response to the tournament play input. The tournament play input may be entered by the participating player through a suitable input device or system associated with the gaming machine, and may include one or more operations (for example a selection in the game and the activation of a "Play" button). The outcome for the given play in the tournament game may be used to produce a score for that play and an overall tournament score may then be incremented accordingly as shown at process block 118.

If the tournament is not complete after the given play of the tournament game, the process loops back to receive another tournament play input at process block 117. However, if the tournament is complete as indicated by a positive outcome from decision box 120 the process proceeds to determine the player's prize for participation in the tournament as shown at process block 122. The tournament prize is then awarded to the player as indicated at process block 123 and the process loops back for further play of the primary game should the player choose to continue play of the primary game as indicated by a positive outcome at decision box 124. This return to primary game play may require reconfiguration of the various graphic displays at the gaming machine if the configuration was changed to initialize the gaming machine for tournament play at process block 116.

There are many variations which may be employed in tournament game play within the scope of the present invention. In particular, the invention encompasses at least two general varieties of tournament play. The tournament play process shown in FIG. 1 is particularly suited for tournaments in which the various participating players may play at different times against established point totals or scores for the given tournament game. The different prizes may be based on probability and/or payback percentage associated with the tournament game. In this variety of tournament play, the player may play the tournament game at any time since they are not playing head-to-head against any other player, but are playing against the established point totals. However, tournaments may also be conducted in which the various participating players play against each other at established times or at times of their own choosing. In this latter case, where players compete directly against each other, the players may be ranked according to highest score and prizes awarded accordingly.

Also, a secondary tournament game or feature may be associated with the tournament game played as indicated in FIG. 1. Such a secondary tournament game my comprise entering the tournament player scores over a given period of time into a competition for the highest scores. At the completion of the given time for collecting scores, the scores may be ranked and the highest score or perhaps the top three ranking scores may be awarded additional prizes.

Figure 2:
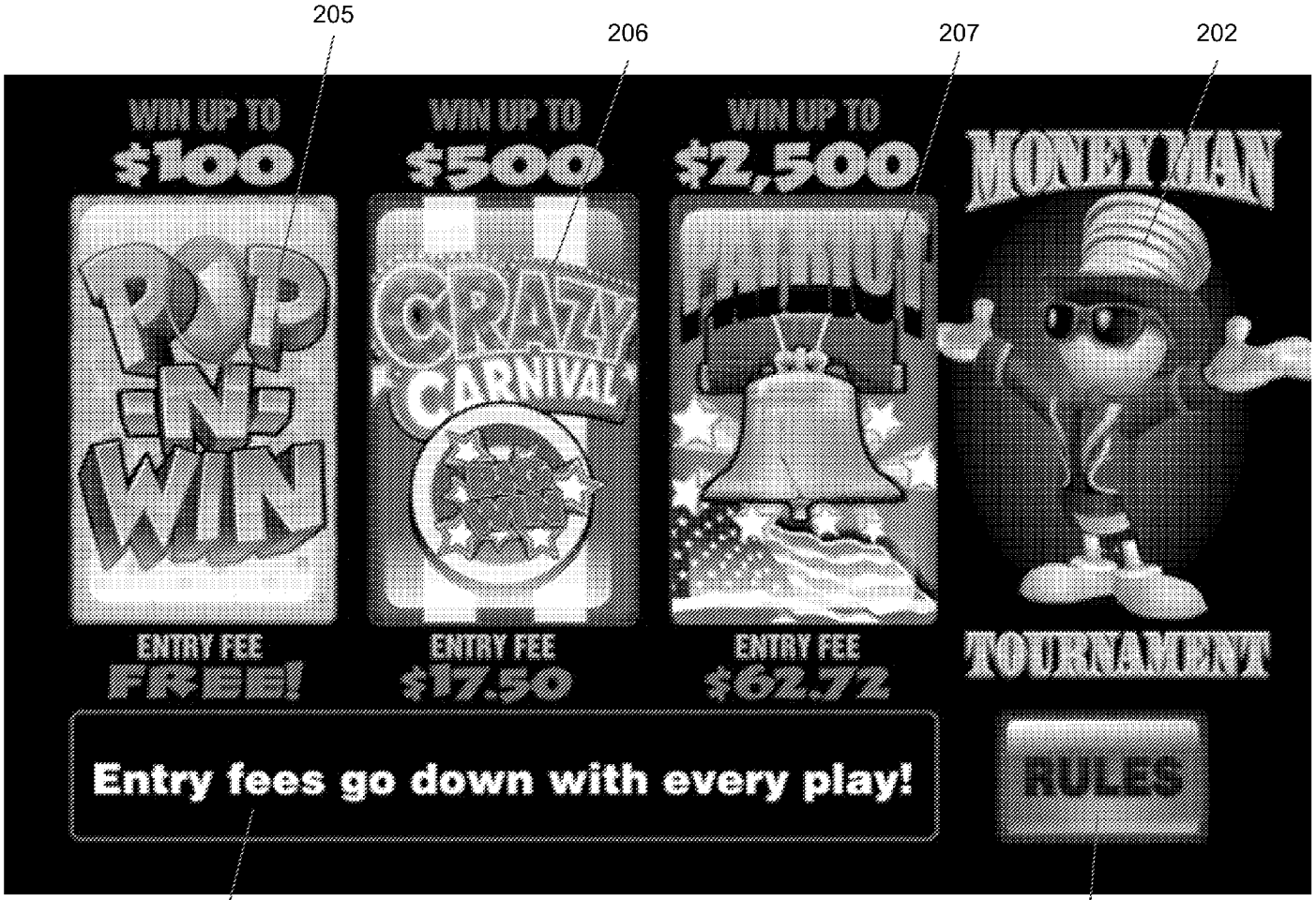
FIG. 2 is a representation of a tournament interface graphic display which may be shown at a gaming machine according to embodiments of the present invention.

As discussed above particularly in connection with process block 111 and decision boxes 108 and 114 in FIG. 1, some implementations of the present tournament gaming system require certain interactions with the player. FIG. 2 provides an example of a touch screen graphic 200 which may be used at a gaming machine to provide an interface between the player and the tournament gaming system. This graphic 200 may be shown on any suitable touch screen display device included at the gaming machine. Graphic 200 may take up the entire surface of the display device or only a portion of the display surface of the display device. An example display device arrangement for showing graphic 200 will be described below in connection with FIGS. 4-6.

Graphic 200 provides an announcement area 201, an animated character 202, and icons 205, 206, and 207 for three different tournaments available through the gaming system. A button icon 208 may be invoked by the player to retrieve rules relating to tournament qualification and play. When button icon 208 is invoked, the rules may be displayed in announcement area 201, or the entire screen area or some other portion may be used to display the requested rules. Numerous other graphic elements, informational elements, and virtual buttons or other controls may be accessible through graphic 200. For example, when it is determined that the entry fee account for has reached a qualifying level for one of the tournaments, announcement area 201, or perhaps other parts of the display area may be used to display an announcement that the entry fee account has reached the qualifying level, and identify the corresponding tournament. Also, each icon 205, 206, and 207 may touched to initiate one or more screens to allow the player to enter the respective tournament, either using the entry fee account to pay the entry fee, or using gaming credit or other value entered at the gaming machine.

Figure 3:
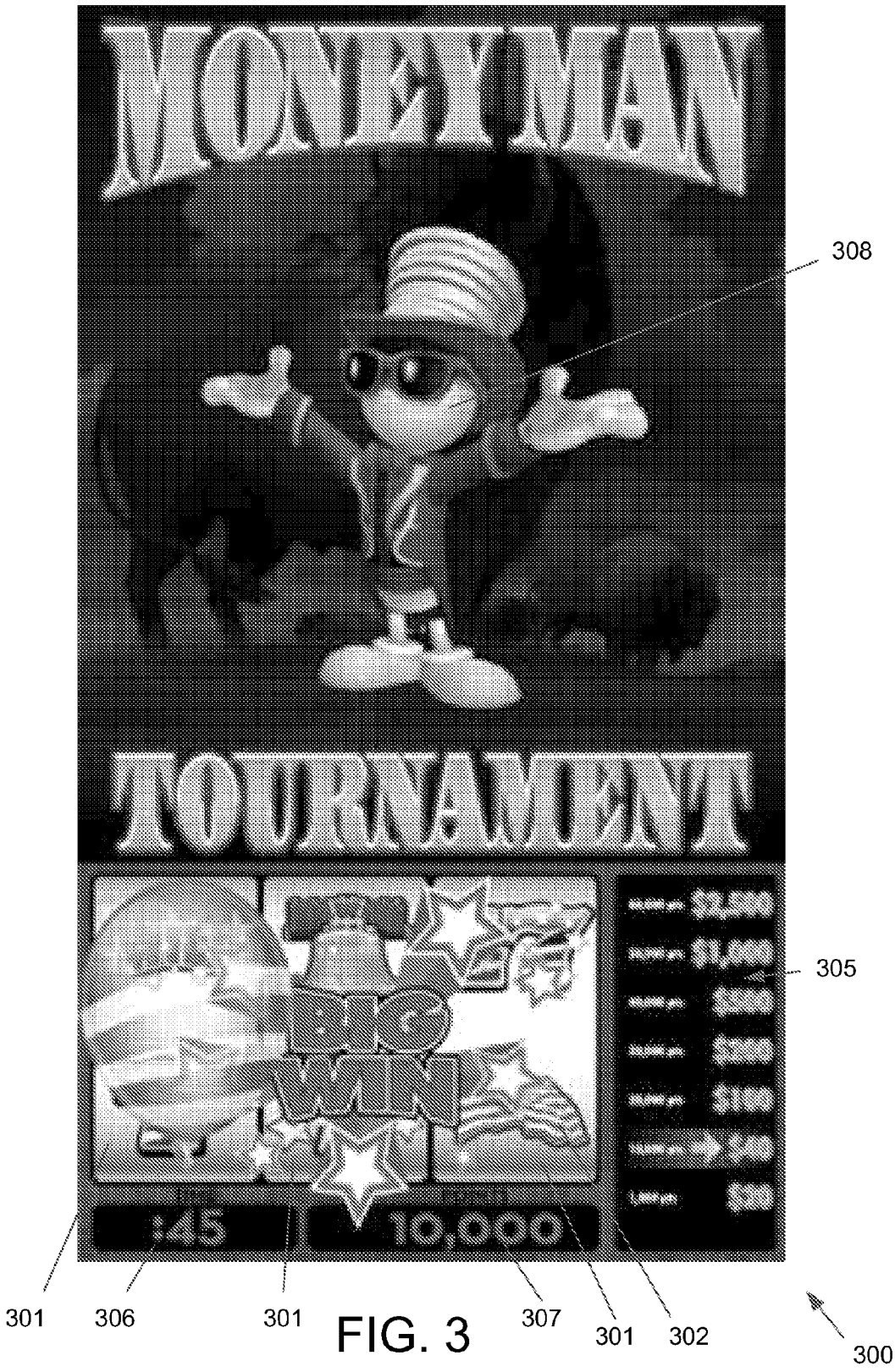
FIG. 3 is a representation of a tournament game display which may be shown at a gaming machine to present a tournament game to a player according to the example process shown in FIG. 1.

FIG. 3 provides an example tournament game graphic 300 that may be used to show a tournament game at the gaming machine. This particular game graphic 300 shows a reel-type game having tree virtual (video-generated) reels 301 showing various symbols 302 which show the outcome for a given play of the tournament game. Graphic 300 also includes a prize level schedule 305, which in this implementation correlates prize values to some minimum point total or score for the game. For example, a final point total over 1000 points and less than 10,000 points entitles the tournament participant to a $20 prize. Graphic 300 further includes a time remaining display area 306, a point total display area 307, and an animated tournament guide character 308.

In the course of initializing the gaming machine for tournament play as shown at process block 116 in FIG. 1, tournament game graphic 300 shown in FIG. 3 may replace the primary game graphic on a primary display of the gaming machine. In this embodiment, graphic 300 would be replaced again by the primary game graphic when the gaming machine transitions back to primary game play after the completion of tournament play. Alternatively to displaying graphic 300 on the primary display of the gaming machine, the graphic may be displayed on some other display device of the gaming machine over the course of tournament game play. In yet other embodiments, the tournament game may use all or part of the graphic employed for the primary game, modified only as necessary to show tournament-related information such as time remaining and the tournament point total.

Figure 4:
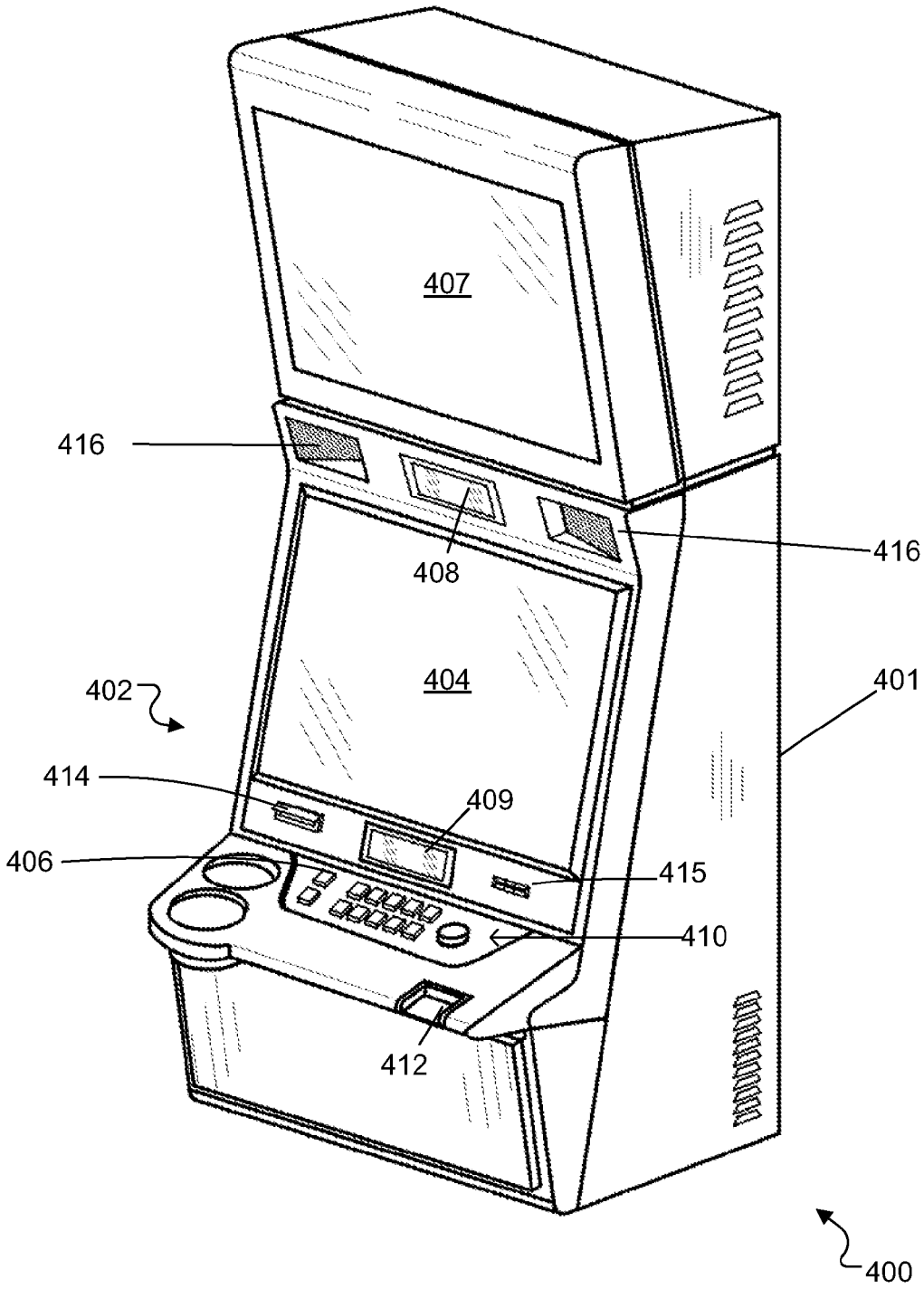
FIG. 4 is a view in perspective of a gaming machine which may be used in various embodiments of the present invention.
Figure 5:
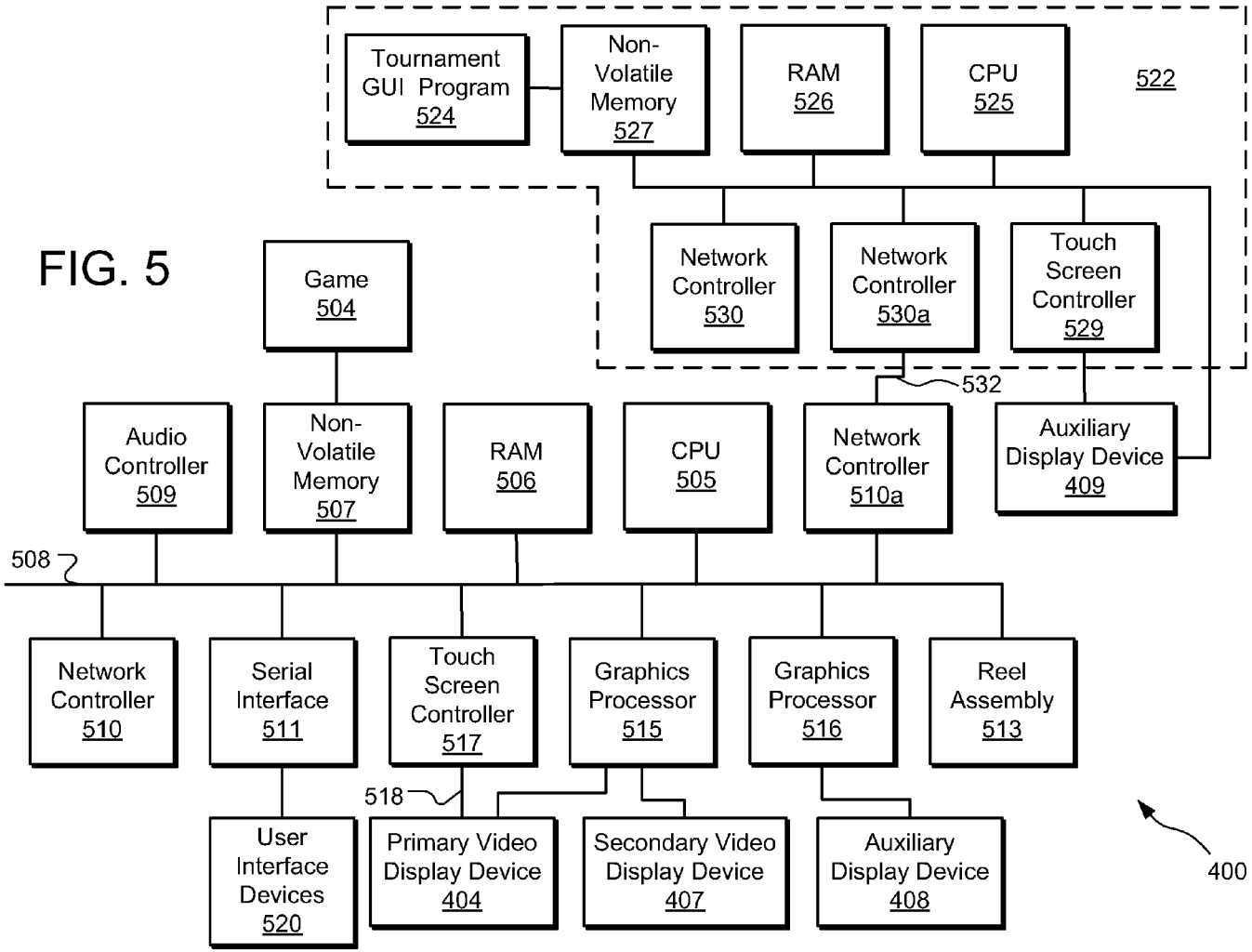
FIG. 5 is a diagrammatic representation showing various components of a gaming machine which may be employed according to one or more embodiments of the present invention.
Figure 6:
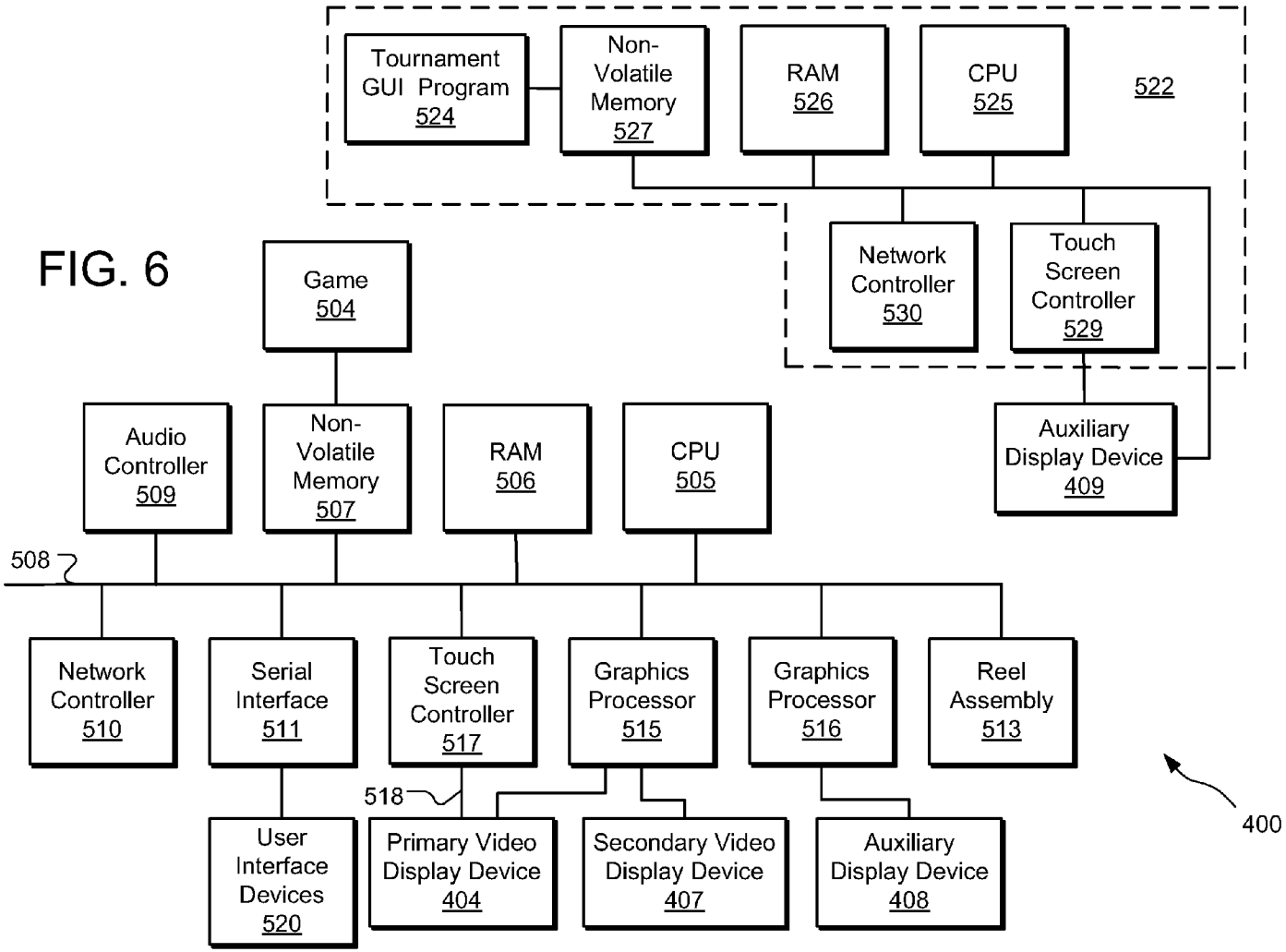
FIG. 6 is a diagram representation showing components of an alternative gaming machine which may be employed in a tournament gaming system according to various embodiments of the invention.
Figure 7:
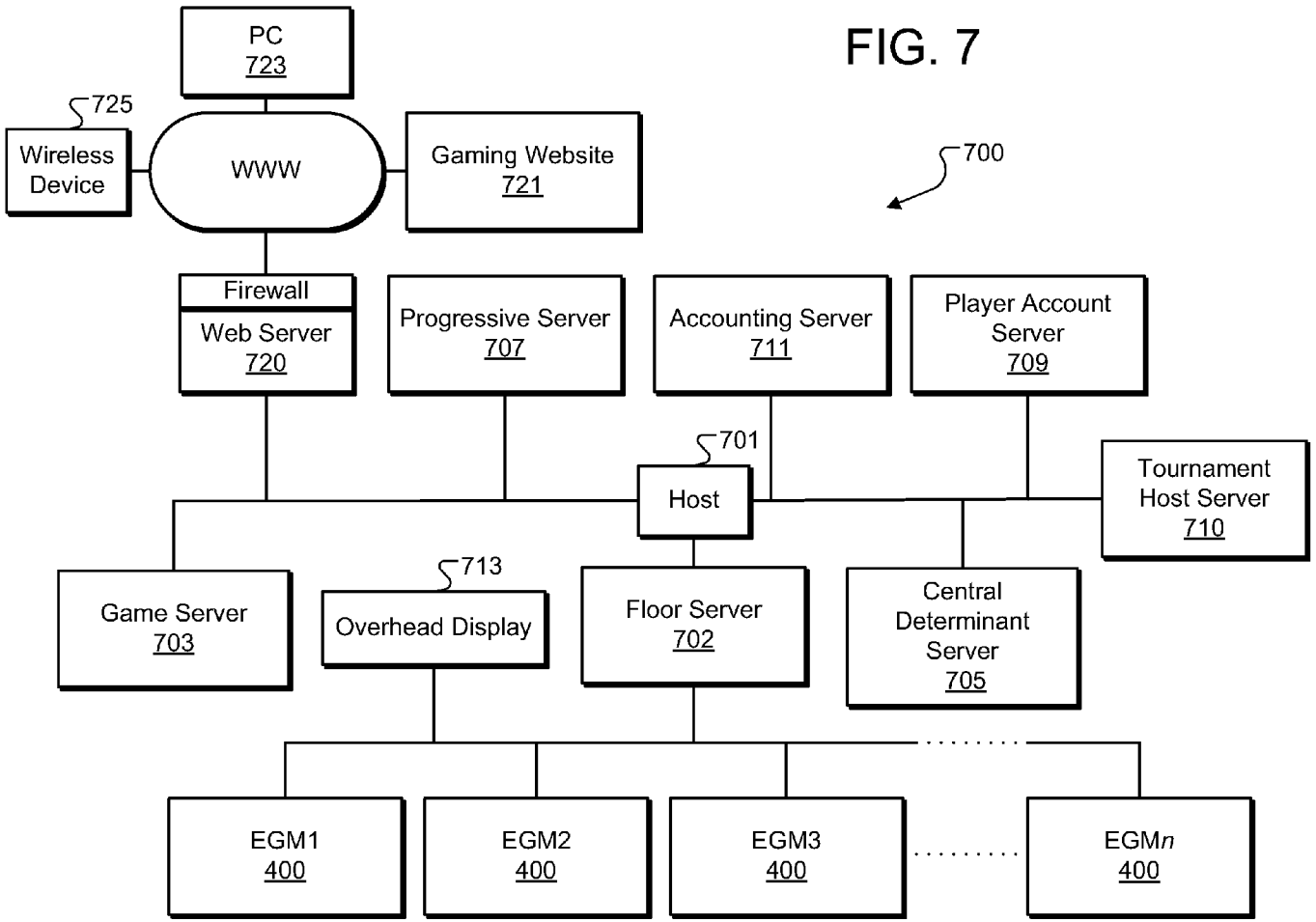
FIG. 7 is diagrammatic representation of a networked gaming system in which the present invention may be implemented.

FIG. 4 shows a gaming machine 400 that may be used to provide a primary wagering game and tournament game as described above in connection with FIG. 1. The block diagrams of FIGS. 5 and 6 show further details of two alternative arrangements to gaming machine 400 along with certain variations which may be employed in the gaming machine, while FIG. 7 shows an example gaming network in which gaming machines such as gaming machine 400 may be employed in implementing a tournament gaming system within the scope of the present invention.

Referring to FIG. 4, gaming machine 400 includes a cabinet 401 having a front side generally shown at reference numeral 402. A primary video display device 404 is mounted in a central portion of the front surface 402, with a button panel 406 positioned below the primary video display device and projecting forwardly from the plane of the primary video display device. In addition to primary video display device 404, the illustrated gaming machine 400 includes a secondary video display device 407 positioned above the primary video display device. Gaming machine 400 also includes two additional smaller auxiliary display devices, an upper auxiliary display device 408 and a lower auxiliary display device 409. This latter auxiliary display device 409 may comprise a touch screen device and may be used to provide the tournament interface graphic 200 described above in connection with FIG. 2. It should also be noted that each display device referenced herein may include any suitable display device including a cathode ray tube, liquid crystal display, plasma display, LED display, or any other type of display device currently known or that may be developed in the future. As will be described further below in connection with FIG. 2 and elsewhere, it is also possible for gaming machines within the scope of the present invention to include mechanical elements such as mechanical reels.

The gaming machine 400 illustrated for purposes of example in FIG. 4 also includes a number of mechanical control buttons 410 mounted on button panel 406. These control buttons 410 may allow a player to select a bet level, select pay lines, select a type of game or game feature, and actually start a play in a primary game. Other forms of gaming machines through which the invention may be implemented may include switches, joysticks, or other mechanical input devices, and/or virtual buttons and other controls implemented on a suitable touch screen video display. For example, primary video display device 404 in gaming machine 400 provides a convenient display device for implementing touch screen controls in addition to or in lieu of mechanical controls. The player interface devices which receive player inputs to initiate the play of a game through the gaming machine, such as controls to select a wager amount for a given play and control to actually start a given play, may be referred to generally as a player input system.

It will be appreciated that gaming machines may also include a number of other player interface devices in addition to devices that are considered player controls for use in playing a particular game. Gaming machine 400 also includes a currency/voucher acceptor having an input ramp 412, a player card reader having a player card input 414, and a voucher/receipt printer having a voucher/receipt output 415. Numerous other types of player interface devices may be included in gaming machines that may be used according to the present invention.

A gaming machine which may be used to implement embodiments of the present invention may also include a sound system to provide an audio output to enhance the user's playing experience. For example, illustrated gaming machine 400 includes speakers 416 which may be driven by a suitable audio amplifier to provide a desired audio output at the gaming machine.

FIG. 5 shows a diagrammatic representation of gaming machine 400 which includes a central processing unit (CPU) 505 along with random access memory 506 and nonvolatile memory or storage device 507. All of these devices are connected on a system bus 508 with an audio interface device 509, a network interface 510, a second network interface 510*a*, and a serial interface 511. A graphics processor 515 is also connected on bus 508 and is connected to drive primary video display device 404 and secondary video display device 407 (both mounted on cabinet 401 as shown in FIG. 4). A second graphics processor 516 is also connected on bus 508 in this example to drive the auxiliary display device 408 also shown in FIG. 5. As shown in FIG. 5, gaming machine 400 also includes a touch screen controller 517 connected to system bus 508. Touch screen controller 517 is also connected via signal path 518 to receive signals from a touch screen element associated with primary video display device 404. It will be appreciated that the touch screen element itself typically comprises a thin film that is secured over the display surface of primary video display device 404. The touch screen element itself is not illustrated or referenced separately in the figures.

The diagrammatic representation of FIG. 5 also shows gaming machine 400 as including a separate tournament interface processing system 522 which may comprise a single board computer. The second processing system 522 is including in the illustrated gaming machine 400 for controlling the tournament system interface content displayed on auxiliary touch screen display device 409 and certain tournament system functions including communications with a tournament host server 710 (which is shown and will be described below in connection with FIG. 7) and communications with the game processor, CPU 505.

Tournament interface processing system 522 includes CPU 525, with its own random access memory (RAM) 526, and non-volatile memory 527, such as a suitable disk-based or solid state hard drive for storing tournament graphical user interface program code 524 and any other program code which may be executed by CPU 525. Processing system 522 also includes network controllers 530 and 530*a*, and touch screen controller 529 connected to a suitable touch screen film or other touch-registering element associated with display device 409.

Those familiar with data processing devices and systems will appreciate that other basic electronic components will be included in gaming machine 400 such as a power supply, cooling systems for the various system components, audio amplifiers, and other devices that are common in gaming machines. These additional devices are omitted from the drawings so as not to obscure the present invention in unnecessary detail.

All of the elements 505, 506, 507, 508, 509, 510, 510*a*, and 511 shown in FIG. 5 are elements commonly associated with a personal computer. These elements are preferably mounted on a standard personal computer chassis and housed in a standard personal computer housing which is itself mounted in cabinet 401 shown in FIG. 4. Alternatively, the various electronic components may be mounted on one or more circuit boards housed within cabinet 401 without a separate enclosure such as those found in personal computers. Tournament interface processing system 522 may comprise a single board computer mounted within cabinet 401 or within a separate EMI enclosure within the cabinet. Those familiar with data processing systems and the various data processing elements shown in FIG. 5 will appreciate that many variations on this illustrated structure may be used within the scope of the present invention. For example, since serial communications are commonly employed to communicate with a touch screen controller such as touch screen controller 517, the touch screen controller may not be connected on system bus 508, but instead include a serial communications line to serial interface 511, which may be a USB controller or a IEEE 1394 controller for example. It will also be appreciated that some of the devices shown in FIG. 5 as being connected directly on system bus 508 may in fact communicate with the other system components through a suitable expansion bus. Audio interface 509, for example, may be connected to the system via a PCI bus. System bus 508 is shown in FIG. 5 merely to indicate that the various components are connected in some fashion for communication with CPU 505 and is not intended to limit the invention to any particular bus architecture. Numerous other variations in the gaming machine internal structure and system may be used without departing from the principles of the present invention. For example, a gaming machine in some embodiments of the present invention may rely on one or more data processors which are located remotely from the gaming machine itself. Embodiments of the present invention may include no processor such as CPUs 505 and 525 or graphics processors such as 515 and 516 at the gaming machine, and may instead rely on one or more remote processors.

It will also be appreciated that graphics processors are also commonly a part of modern computer systems. Although separate graphics processor 515 is shown for controlling primary video display device 404 and secondary video display device 407, and graphics processor 416 is shown for controlling auxiliary display device 408, CPU 505 may control all of the display devices directly without any intermediate graphics processor. Similarly, although processing system 522 is shown as including no separate graphic processor for controlling display device 409 (thus implying that the graphics processing for display device 409 is handled by CPU 525), implementations of the invention may include a processing system such as system 522 with a separate graphics processor. The invention is not limited to any particular arrangement of processing devices for controlling the video display devices included with gaming machine 400. Also, a gaming machine implementing the present invention is not limited to any particular number of video display device or other types of display devices.

In the illustrated gaming machine 400, CPU 505 executes software which ultimately controls primary game play and related functions and tournament game play including the receipt of player inputs and the presentation of the graphic symbols displayed according to the invention through the display devices 404, 407, and 408 associated with the gaming machine. CPU 505 also executes software related to communications handled through network interfaces 510 and 510*a*, and software related to various peripheral devices such as those connected to the system through audio controller 509, serial interface 511, and touch screen controller 517. CPU 505 may also execute software to perform accounting functions associated with play of the primary game. Random access memory 506 provides memory for use by CPU 505 in executing its various software programs while the nonvolatile memory or storage device 507 may comprise a hard drive or other mass storage device providing storage for game software such as game program code 504 prior loading into random access memory 506 for execution, or for programs not in use or for other data generated or used in the course of gaming machine operation. Network interface 510 provides an interface to other components of a gaming system in which gaming machine 400 may be included. An example network will be described below in connection with FIG. 3. Network interface 510*a* provides an interface to the separate processing system 522 via network controller 530*a* and crossover cable 532.

It should be noted that the invention is not limited to gaming machines employing the personal computer-type arrangement of processing devices and interfaces shown in example gaming machine 400. Other gaming machines through which the tournament gaming system may be implemented may include one or more special purpose processing devices to perform the various processing steps for implementing the present invention. Unlike general purpose processing devices such as CPU 505, which may comprise an Intel Pentium® or Core® processor for example, these special purpose processing devices may not employ operational program code to direct the various processing steps.

The example gaming machine 400 which may be used to implement some embodiments of the present invention is shown in FIG. 5 as including a user interface devices 520 connected to serial interface 511. These user interface devices may include various player input devices such as mechanical buttons shown on button panel 406 in FIG. 4, and/or levers, and other devices. It will be appreciated that the interface between CPU 505 and other player input devices such as player card readers, voucher readers or printers, and other devices may be in the form or serial communications. Thus user serial interface 511 may be used for those additional devices as well, or the gaming machine may include one or more additional serial interface controllers. However, the interface between peripheral devices in the gaming machine, such as player input devices, is not limited to any particular type or standard for purposes of the present invention.

Reel Assembly 513 is shown in the diagrammatic representation of FIG. 5 to illustrate that a gaming machine which may be used for various embodiments of the invention may include mechanical reels. For example, a set of mechanical reels may replace the primary display device 504, or at least part of that display device. Alternatively, mechanical reels may be included in the gaming machine behind a light-transmissive video display panel. Although the invention is not limited to any particular mechanical reel arrangement or control system, mechanical reels may be controlled conveniently through serial communications which provide instructions for a respective stepper motor for each reel. Thus some embodiments of the present invention which employ mechanical reels may use a serial interface device such as serial interface controller 511 to control communications with the reel assembly, and may not include a dedicated interface as indicated by FIG. 5. Details of a mechanical reel arrangement are not shown in the present figures so as to avoid obscuring the present invention in unnecessary detail.

The diagrammatic representation of FIG. 6 shows an alternate configuration for the various processing elements and controllers which may be included in gaming machine 400. In this configuration, tournament interface processing system 522 does not communicate directly with the processing system including CPU 505. Thus the configuration shown in FIG. 6 omits network controllers and a connection (network controllers 510*a*, 530*a*, and crossover cable 532 in FIG. 5) for accommodating such direct communications.

It will be appreciated that the diagrammatic representations shown in FIGS. 5 and 6 are shown only to show examples of how gaming machine 400 may be configured for use in a tournament gaming system implementing processes embodying the principles of the invention, such as process 100 shown in FIG. 1 for example. Numerous variations on these generalized configurations are possible within the scope of the present inventions. For example, as processing power available in microprocessor devices increases in the future it is anticipated that all processing performed in the illustrated configurations by CPU 505 and CPU 525 may be performed instead by a single microprocessor. From a technical standpoint, this greater processing capability would obviate the need for the separate tournament interface processing system 522 shown in both FIGS. 5 and 6. Also, as noted above in connection with FIG. 5, alternative implementations may position the processing power provided by the CPUs at a location remote from the gaming machine itself. In configurations employing remote processing, the gaming machine would retain the display devices and user input devices and these devices would communicate with the remote processor or processors using a suitable interface.

It should also be noted that regulatory requirements may affect the configuration of gaming machines 400 which may be used in gaming systems implementing the present invention. For example, some regulatory environments may allow communications to and from a game processor such as CPU 505 with another processing system within the gaming machine such as processing system 522. In these regulatory environments, the configuration using direct communications via crossover cable 532 shown in FIG. 5 may be employed. However, regulatory environments that do not allow such communications with the game processor may require the gaming machine configuration shown in FIG. 6.

Referring now to FIG. 7, a networked gaming system 700 associated with one or more gaming facilities may include one or more networked gaming machines 400 (EGMs) connected in the network by suitable network cable or wirelessly.

The example gaming network 700 shown in FIG. 7 includes a host server 701 and floor server 702, which together may function as an intermediary between floor devices such as gaming machines 400 and back office devices such as the various servers described below. Game server 703 may provide server-based games and/or game services to network connected gaming devices such as gaming machines 700. Central determinant server 705 may be included in the network to identify or select lottery, bingo, or other centrally determined game outcomes and provide the information to networked gaming machines 400 providing lottery and bingo-based wagering games to players.

Tournament host server 710 is included in network 700 for supporting the tournament-related processes such as the tournament qualification and tournament game scoring processes described above in connection with FIG. 1 for example. In particular, tournament host server 710 may receive primary game play and wagering information and entry fee payment information from each gaming machine 400 in order to perform the tournament qualification functions shown at 106, 107, 108, and 109 in FIG. 1. That is, the entry fee account for each gaming session or associated with each player or player ID may be maintained at tournament host server 710. Tournament host server 710 may also direct the tournament interface graphic, such as graphic 200 in FIG. 2, to display the tournament offer as indicated at process block 111 in FIG. 1. All or part of the tournament game score keeping, tournament prize determination, and awarding of tournament prizes (blocks 118, 120, 122, and 123 in FIG. 1) may be performed by processes executing at tournament host server 710. Furthermore, during the course of tournament game play through a graphic such as 300 shown in FIG. 3, tournament host server 710 may provide information to the respective gaming machine 400 to update the prize level schedule 305 and point display 307 also shown in FIG. 3. Tournament host server 710 may also be responsible for sending a control signal to a respective gaming machine 400 to prompt that gaming machine to initialize for play of a tournament game (as at process block 116 in FIG. 1), and switch the gaming machine back to the primary game once a tournament has been completed at the gaming machine.

It will be appreciated that the nature of communications between a gaming machine 400 and tournament host server 710 in a give embodiment of the invention will be somewhat dependent upon the configuration of the gaming machine and the network or networks in which they are connected. For example, in the gaming machine 400 configuration shown in FIG. 5, CPU 505 is able to communicate game play information and tournament play information directly to CPU 525. Thus it is processing system 522 that may send information to tournament host server 710 necessary for that server to perform the entry fee account maintenance and tournament play scoring. However, in the gaming machine 400 configuration shown in FIG. 6, CPU 505 may be responsible for communicating primary game play and tournament play information to directly to tournament host server 710.

The functions performed by tournament host server 710 may also depend on the nature of the tournaments which are available in the gaming system. For example, tournament host server 710 may maintain the schedule for head-to-head play tournaments in which the players play the tournament game at the same time. Tournament controller 710 may also be responsible for conducting any secondary tournaments that may be implemented in the gaming system.

It will also be appreciated that tournament host server 710 may require or allow certain casino operator inputs to setup tournaments and otherwise administer the tournament system. Thus tournament host server 710 also provides an operator interface, which may be a web browser-accessed interface, to allow various administrative operator inputs.

Progressive server 707 may accumulate progressive awards by receiving defined amounts, such as a percentage of the wagers from eligible gaming devices or by receiving funding from marketing or casino funds. Progressive server 707 may also provide progressive awards to winning gaming devices in response to a progressive event. Such a progressive event may comprise, for example, a progressive jackpot game outcome or other triggering event such as a random or pseudo-random win determination at a networked gaming device or server. Accounting server 711 may receive gaming data from each of the networked gaming devices, perform audit functions, and provide data for analysis programs. Player account server 709 may maintain player account records, and store persistent player data such as accumulated player points and/or player preferences (for example, game personalizing selections or options).

Networked gaming machines 400 (EGM1-EGMn) and one or more overhead displays 713 may be operatively connected so that the overhead display or displays may mirror or replay the content of one or more displays of gaming machines 400. For example, the primary display content for a given gaming machine 400 may be stored by a display controller or game processor 505 or tournament interface processor 525 of the given gaming machine and transmitted through network controller 510 as shown in FIG. 5 to a controller (not shown) associated with the overhead display(s) 713. In the event gaming machines 400 have cameras installed, the respective players' video images may be displayed on overhead display 713 along with the content of the player's gaming machine display.

Example gaming network 700 also includes a gaming website 721 which may be hosted through web server 720 and may be accessible by players via the Internet. One or more games may be displayed as described herein and played by a player through a personal computer 723 or handheld wireless device 725 (for example, a Blackberry® cell phone, Apple® iPhone®, personal digital assistant (PDA), iPad®, etc.). To enter website 721, a player may log in with a user name that may, for example, be associated with the player's account information stored on player account server 709. Once logged onto website 721 the player may play various games on the website. Also website 721 may allow the player to make various personalizing selections and save the information so it is available for use during the player's a next gaming session at a casino establishment having the gaming machines 400.

Website 721 may also provide functions associated with tournament play through gaming machines 400. For example, players may be allowed to create a tournament account through website 721 which may be associated with an entry fee account for the player. Additionally, website 721 may allow players to create their own tournaments open or invitational tournaments. For invitational tournaments, the tournament organizing player may select other players which are to receive an invitation for play the organizing player's tournament. Once the organizing player's tournament has been created, web server 720 may cause the appropriate resources to issue email invitations, text message invitations, or invitations communicated via some other route to the respective invitees for the tournament. Information regarding player-created tournaments and participating or invited players may be communicated to tournament host server 710. This player-created tournament information allows tournament host server 710 to control the tournament interface graphic, such as example graphic 200 shown in FIG. 2, to display information specific to an invitee player logged on to a given gaming machine 400. For example, in addition to the three casino-created tournament icons 205, 206, and 207 shown for example in FIG. 2, the graphic may be modified for an invitee player to show an icon for the player-created tournament instead of or in addition to the icons shown in graphic 200. Also, tournament host server 710 may use the information on player-created tournaments and invitees to cause a tournament interface graphic such as graphic 200 to display announcements for the player-created tournament. An invitee player receiving such an announcement may make an entry through interface graphic 200 or otherwise to accept or decline the player-created tournament. Regardless of how an invitee player is made aware of a player-created tournament, the invitee player may pay down the entry fee for the tournament in the manner described above in connection with FIG. 1. The player-created tournament may designate an entry fee, and the entry fee account tracked according to blocks 107 and 109 in FIG. 1 may be used to pay the entry fee for the tournament. Of course, the invitee player may also be allowed to simply pay all or a remaining part of the entry fee for the player-created tournament just as for any other tournament which may be available according to the present invention.

Player-created tournaments organized through website 721 may be created for play against a scoring table such as that illustrated at 305 in FIG. 3, or created for head-to-head play. Player-created tournaments will typically be playable for a certain period of time defined by the organizing player or the casino, however, some player-created tournaments may be organized to require that the various players all participate in the tournament game at the same time.

It will be appreciated that gaming network 300 illustrated in FIG. 7 is provided merely as an example of a gaming network in which tournaments may be offered according to embodiments of the present invention, and is not intended to be limiting in any way. In particular, servers shown separately in the example of FIG. 7 may be combined in a single physical processing device, or the processing duties of the various illustrated servers may be split into additional physical devices. Furthermore, a tournament gaming system according to one or more embodiments of the present invention may be implemented using any suitable network topology. For example, tournament host server may be connected in a network with the various tournament interface processing systems 522 (In FIGS. 5 and 6), and may communicate with other servers shown in FIG. 7 through a separate network.

As used in the foregoing description and the following claims, the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above-described example embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method including:

receiving one or more primary game inputs at a gaming machine, each primary game input defining a wager for a respective play of primary game presented through the gaming machine and initiating the respective play of the primary game;

generating an outcome for each play of the primary game and displaying a graphical representation of the respective outcome at a display device associated with the gaming machine;

awarding a payout for each respective winning outcome according to a paytable for the primary game;

initiating a tournament game for a first tournament at the gaming machine;

maintaining a point total based on each outcome generated for a respective play of the tournament game;

upon completion of the first tournament, awarding a tournament prize based on a final value of the point total;

entering the final value of the point total into a secondary tournament; and upon completion of the secondary tournament, awarding a secondary tournament prize based on a rank of the final value of the point total with respect to other point total values collected for the secondary tournament.

2. The method of claim 1 further including:

for each wager placed for a respective play of the primary game comprising a qualifying wager, incrementing a value of a tournament entry fee account associated with that respective play of the primary game; and in response to the value of the tournament entry fee account reaching a first predefined level, enabling participation in the first tournament.

3. The method of claim 2 further including receiving a tournament fee entry input at the gaming machine, and incrementing the value of the tournament entry fee account in response to the tournament fee entry input.

4. The method of claim 2 further including enabling participation in at least one additional tournament in response to the value of the tournament entry fee account reaching an additional predefined level for the respective additional tournament.

5. The method of claim 2 wherein each qualifying wager in the primary game comprises a wager amount over a predefined threshold wager amount.

6. The method of claim 2 wherein each wager in the primary game is defined as a qualifying wager.

7. The method of claim 1 wherein the secondary tournament is defined for a period of time and wherein the final value of the point total is entered into the secondary tournament by virtue of having been attained within the time period defined for the secondary tournament.

8. A gaming system including:

at least one display device;

a player input system;

at least one processor; and at least one memory device storing instructions executable by the at least one processor to:

receive one or more primary game inputs entered through the player input system, each primary game input defining a wager for a respective play of primary game presented through the at least one display device and initiating the respective play of the primary game;

generate an outcome for each play of the primary game and cause the at least one display device to display a graphical representation of the respective outcome;

award a payout for each respective winning outcome according to a paytable for the primary game;

initiate a tournament game for a first tournament at the gaming machine;

maintain a point total based on each outcome generated for a respective play of the tournament game;

upon completion of the first tournament, award a tournament prize based on a final value of the point total;

enter the final value of the point total into a secondary tournament; and upon completion of the secondary tournament, award a secondary tournament prize based on a rank of the final value of the point total with respect to other point total values collected for the secondary tournament.

9. The gaming system of claim 8 wherein the player input system includes a primary game and tournament game input arrangement, and a tournament entry input arrangement separate from the primary game and tournament game input arrangement.

10. The gaming system of claim 8 wherein:

the at least one processor includes a game processor and a separate tournament entry processor, both located in a gaming machine cabinet; and the at least one memory device includes (i) a game processor memory device storing instructions executable by the game processor to generate the outcome for each play of the primary game and award the payout for each respective winning outcome of the primary game, and (ii) a separate tournament entry memory device storing instructions executable by the tournament entry processor to control a display device to display tournament entry options.

11. The gaming system of claim 10 wherein:

the game processor is operatively connected for communication with the tournament entry processor and is also operatively connected to a gaming network; and the tournament entry processor is operatively connected to a tournament control network.

12. The gaming system of claim 10 wherein:

the game processor is operatively connected to a gaming network and to a tournament control network; and the tournament entry processor is operatively connected to a tournament control network.

13. The gaming system of claim 10 wherein:

the at least one processor includes a tournament host processor located remotely from the gaming machine cabinet; and the at least one memory device includes a tournament host memory device located remotely from the gaming machine cabinet storing instructions executable by the tournament host processor to, for each wager placed for a respective play of the primary game which comprises a qualifying wager, increment the value of a tournament entry fee account associated with that respective play of the primary game.

14. The gaming system of claim 8 wherein the at least one display device includes:

a primary game display device mounted on a gaming machine cabinet; and a tournament entry interface display device mounted on the gaming machine cabinet separate from the primary game display device.

15. A program product stored on one or more non-transitory computer readable data storage devices, the program product including:

player input program code executable by at least one processor to (i) receive one or more primary game inputs entered through a player input system of a gaming machine, each primary game input defining a wager for a respective play of primary game presented through at least one display device of the gaming machine and initiating the respective play of the primary game, and to (ii) receive one or more tournament game inputs entered through the player input system once tournament game play is enabled at the gaming machine;

primary game program code executable by the at least one processor to (i) generate an outcome for each play of the primary game and cause the at least one display device to display a graphical representation of the respective outcome, and to (ii) award a payout for each respective winning outcome according to a paytable for the primary game;

tournament game program code executable by the at least one processor to (i) generate an outcome for each play of a tournament game for a first tournament and cause the at least one display device to display a graphical representation of the respective outcome for the tournament game for the first tournament, and to (ii) award tournament points for each respective winning outcome for the tournament game for the first tournament according to a paytable for the tournament game for the first tournament, and to (iii) enter a total of the awarded tournament points into a secondary tournament, and to (iv) upon completion of the secondary tournament, award a secondary tournament prize based on a rank of the total of the awarded tournament points with respect to other point total values collected for the secondary tournament.

16. The program product of claim 15 further including tournament entry program code executable by the at least one processor to (i), for each wager placed for a respective play of the primary game which comprises a qualifying wager, increment a value of a tournament entry fee account associated with that respective play of the primary game, and to (ii) enable participation in the first tournament in response to the value of the tournament entry fee account reaching a first predefined level.

17. The program product of claim 16 wherein the tournament entry program code is also executable by the at least one processor to receive one or more tournament selection inputs entered through the player input system of the gaming machine.

18. The program product of claim 16 further including tournament prize program code executable by the at least one processor to award a tournament prize based on the total of the awarded tournament points in the first tournament.

* * * * *